US005697879A

United States Patent [19]

Nokelainen

[11] Patent Number: 5,697,879

[45] Date of Patent: Dec. 16, 1997

[54] METHOD FOR FOLDING GLUEING OF A SHEET OF PAPER CONTAINING INFORMATION

[75] Inventor: Risto Nokelainen, Kirkkonummi, Finland

[73] Assignee: Mail Systems Oy, Espoo, Finland

[21] Appl. No.: 392,815

[22] PCT Filed: Aug. 25, 1993

[86] PCT No.: PCT/FI93/00334

§ 371 Date: Apr. 17, 1995

§ 102(e) Date: Apr. 17, 1995

[87] PCT Pub. No.: WO94/05510

PCT Pub. Date: Mar. 17, 1994

[30] Foreign Application Priority Data

Aug. 27, 1992 [FI] Finland ..... 923852

[51] Int. Cl.[6] ..... B42D 15/08; B31B 19/00

[52] U.S. Cl. ..... 493/264; 493/255; 493/917

[58] Field of Search ..... 493/231, 243, 493/255, 264, 265, 267, 357, 360, 409, 461, 917

[56] References Cited

U.S. PATENT DOCUMENTS

| | | | |
|---|---|---|---|
| 4,928,875 | 5/1990 | Hutchinson | 229/92.1 |
| 5,174,493 | 12/1992 | File | 229/301 |
| 5,289,972 | 3/1994 | Sauerwine | 229/303 |
| 5,294,041 | 3/1994 | Whiteside | 229/69 |
| 5,328,438 | 7/1994 | Crowley | 493/187 |
| 5,360,159 | 11/1994 | Perriman | 229/62.3 |
| 5,360,160 | 11/1994 | Sauerwine | 229/304 |
| 5,370,304 | 12/1994 | Sauerwine | 229/304 |
| 5,376,048 | 12/1994 | Whiteside | 462/6 |
| 5,391,136 | 2/1995 | Makowka | 493/210 |
| 5,402,934 | 4/1995 | Sauerwine | 229/303 |

FOREIGN PATENT DOCUMENTS

| | | |
|---|---|---|
| 0 302 796 | 2/1989 | European Pat. Off. . |
| 91139 | 2/1994 | Finland . |
| 3 628 070 | 2/1988 | Germany . |

*Primary Examiner*—Joseph J. Hail, III
*Assistant Examiner*—Christopher W. Day
*Attorney, Agent, or Firm*—Young & Thompson

[57] ABSTRACT

A method for folding and glueing a sheet of paper that contains informations and serves both as a letter and an envelope, wherein the sheet (40) is folded transverse to its parallel lateral edges (41). The lateral edges (41), the end edge (45) of the last folded sheet portion (40*a*) and the transverse edge (46) are closed by glue joints, and the folded and glued lateral edges (41) and the transverse edge (46) are perforated. The travel direction of the sheet is changed by about 90° after treatment of the lateral edges (41). To make the transverse glue joints tight, transverse glueing of the end edge (45) of the last folded sheet portion (40*a*) and the transverse edge (46) is performed just before perforation of these parts by opening slightly the sheet portions (40*a*, 40*b*, 40*c*) that are to be glued together and by spraying glue on the slots.

7 Claims, 2 Drawing Sheets

METHOD FOR FOLDING GLUEING OF A SHEET OF PAPER CONTAINING INFORMATION

The invention relates to a method for folding and gluing a sheet of paper that contains information and serves both as a letter and an envelope, wherein the sheet is folded transverse to its parallel lateral edges, and said lateral edges, the end edge of the last folded sheet portion and the transverse edge are closed by glue joints, and the folded and glued lateral edges and the transverse edge are perforated, and wherein the travel direction of the sheet is changed by about 90° after treatment of the lateral edges.

BACKGROUND OF THE INVENTION

In previously known folding gluing methods the sheet of paper is passed along a straight path throughout the process in a folding gluing machine operating on a cold sealing principle. To begin with, glue is applied to two parallel lateral edges of the sheet. Subsequently the sheet is forwarded to grooved rolls, which have glue nozzles in the grooves for spraying points of glue on one end of the sheet. The sheet is then folded perpendicular to the lateral edges. Due to the folding and gluing, the sheet forms a closed document, e.g. a letter ready for mailing. Usually the sheet is folded twice, and the two lateral edges of the folded and glued sheet are perforated to facilitate opening. The glued end of the sheet is opened by tearing. In documents like this, the actual information is not written on the same side of the unfolded sheet as the information about the sender and the receiver.

The drawback of the method and the closed document produced by it is that glue points cannot be sprayed sufficiently close to one another on the end of the sheet to make it impossible for an outsider to peek at the letter by opening it slightly between the glue points. It is true that double folding restricts the possibility of peeking at the document to some extent, but the condition is that text be printed on both sides of the unfolded sheet, as stated above. This in turn reduces the rate of printing of the sheet.

It is also known to produce pre-glued sheets of paper in which all information is to be printed on one side and which are folded only once. Documents folded from these sheets are well protected against outsiders, but they require a specific heat-sealing folding machine. Pre-glued sheets are also very expensive.

SUMMARY OF THE INVENTION

The object of the present invention is to eliminate the above drawbacks and to provide a method by which documents well protected against outsiders can be produced without the use of pre-glued sheets and in which gluing can be performed by conventional cold sealing.

The objects are achieved with the method of the invention, which is characterised in that transverse gluing of the end edge of the last folded sheet portion and the transverse edge is performed just before perforation of these parts by opening slightly the sheet portions that are to be glued together and by spraying glue on the slots.

The essential difference of the present invention over the previously known method is that transverse gluing for final closing of the sheet, i.e. gluing in a folding direction of the sheet, is not performed until after the sheet has been folded and is performed without the known gluing rolls. For the transverse gluing, the travel direction of the sheet is changed to be perpendicular to the earlier travel direction, whereby glue can be sprayed on the joints to be glued from the sides of the folded sheet as the sheet moves forward. This in turn makes it possible to provide a uniform glue joint, whereby the text on the closed sheet cannot be read without opening the sheet.

In the method of the invention all the information contained in the sheet can be printed on one side of the unfolded sheet even though the sheet is then folded several times. Single-sided printing requires only about half as much time as double-sided printing.

BRIEF DESCRIPTION OF THE DRAWINGS

In the following the invention will be described in greater detail with reference to the attached drawings, in which.

DETAILED DESCRIPTION OF THE INVENTION

Figure 1:
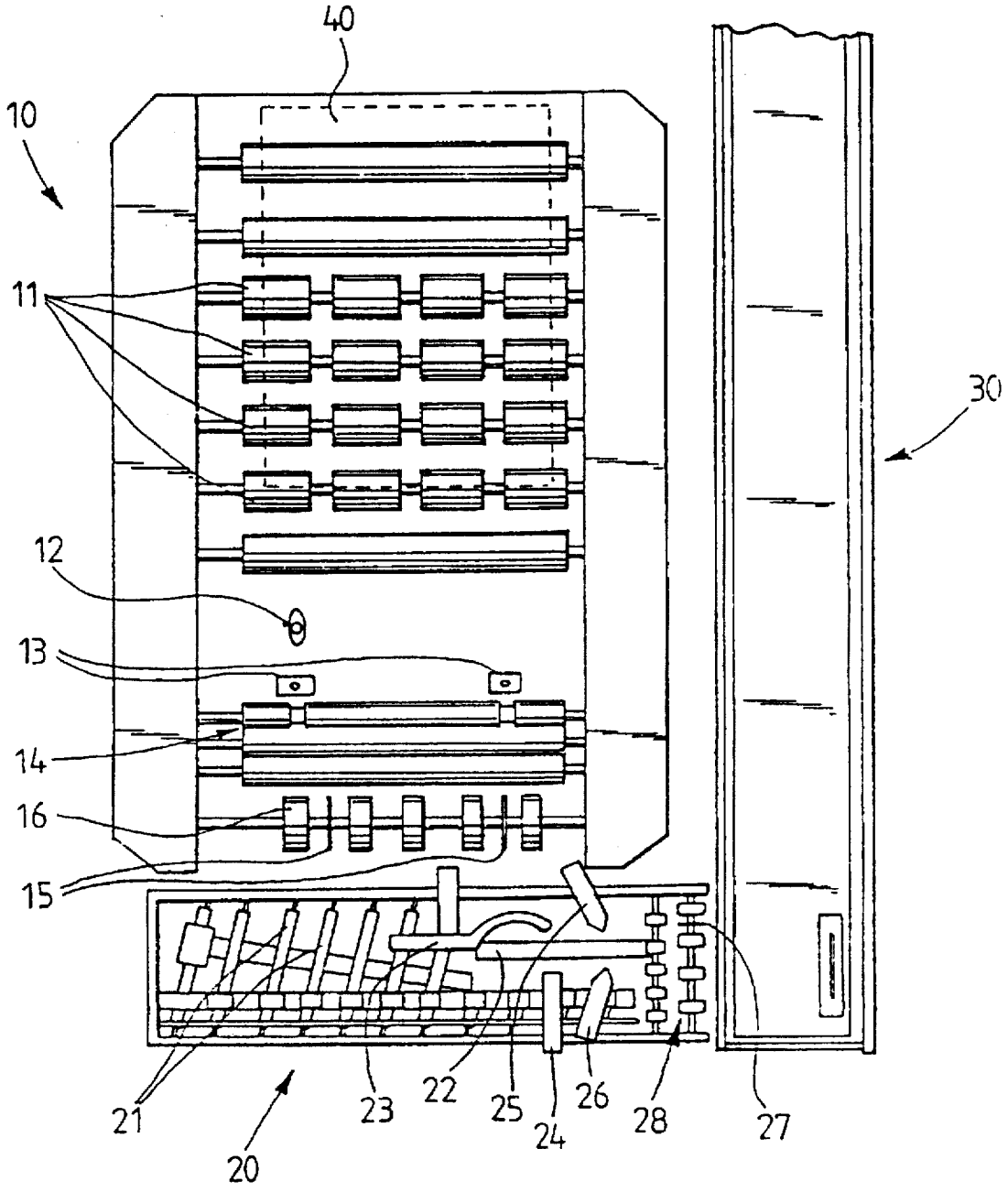
FIG. 1 shows a folding gluing machine used in carrying out the method of the invention.

The folding gluing machine of FIG. 1 operating on a cold sealing principle comprises a first path 10 for paper and a second path 20 for paper, which are perpendicular to each other. At the end of the second path 20 perpendicular thereto, a conveyor line 30 for finished material may be arranged, the line being parallel to the first path 10, but the material moving to the opposite direction as compared with the path 10.

At the beginning of the first path 10 are arranged first feeding rolls 11 for a sheet 40 to be treated. They are followed by an optical reader 12, glue-guns 13 for spraying glue on two parallel lateral edges 41 of the sheet 40, folding rolls 14 for folding the sheet 40 against the travel direction, i.e. transverse to the lateral edges 41, and finally, perforating blades 15 for perforating the glued lateral edges, and second feeding rolls 16 for forwarding the sheet 40 via the perforating blades 15 to the second path 20.

The second path 20 comprises conveyor rolls 21 and a conveyor line 22 for forwarding the sheet of paper obtained from the first path 10 perpendicularly in respect of the path 10, i.e. in such a way that the travel direction of the sheet 40 changes by about 90° C., opening means 23 and 24 for slightly opening the end edge 45 and the transverse edge 46 of the folded sheet 40, glue-guns 25 and 26 located after the opening means 23 and 24 for spraying glue on the slightly opened end edge 45 and on the transverse edge 46, and finally a perforating blade 27 for providing perforation close to the transverse glue joint 48 of the transverse edge 46 of the sheet, and feeding rolls 28 for forwarding the sheet 40 via said perforating blade 27 and introducing the finished sheet 40 into the conveyor line 30. The above-mentioned opening means 23 and 24 may be either mechanical or pneumatic. In this embodiment, the means 23 for opening the end edge 45 are advantageously mechanical and the means 24 for opening the transverse edge are pneumatic.

Figures 2, 3:
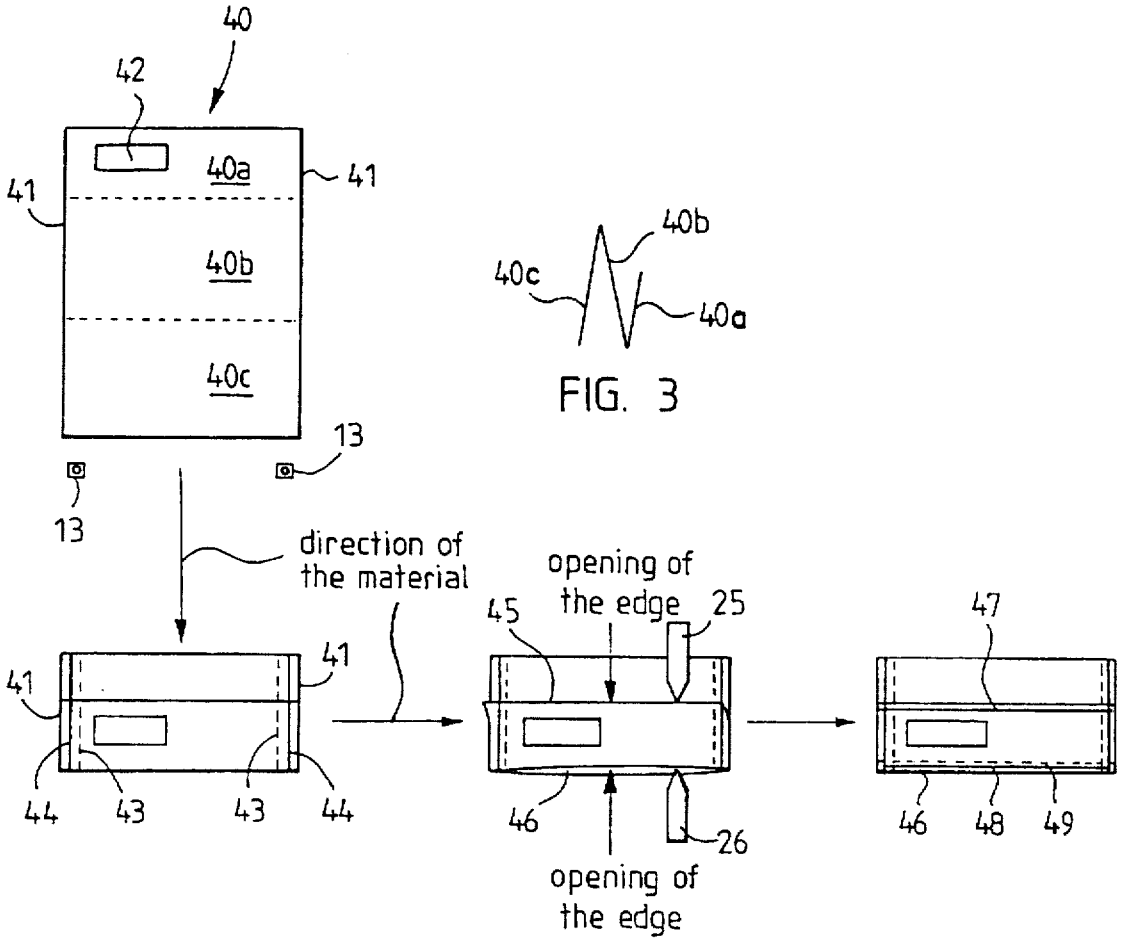
FIG. 2 shows how a sheet of paper travels in the machine of FIG. 1.
FIG. 3 shows a side view of an unglued sheet folded according to the invention.

FIG. 2 shows the path of the sheet 40 in the above machine in which the sheet 40 is treated by the method of the invention. All information is printed on one side of the sheet 40, whereby e.g. an address field 42 is situated at the top of the unfolded sheet 40.

As the sheet 40 moves on the first path 10 of the folding gluing machine, glue is first applied by glue-guns 13 to the parallel lateral edges 41 of the sheet 40. The sheet 40 is then folded twice with folding rolls 15, transverse to the lateral edges 41, in such a way that the second fold is reverse to the first fold, whereby the address field 42 stays in sight and the lateral edges 41 of all sheet portions 40*a* and 40*b* except the last sheet portion 40*c* adhere together. The glued lateral edges 41 are then perforated with perforating blades 15: perforations 43 are provided close to glue lines 44 further away from the edges 41 of the sheet 40 than the glue lines 44 are.

For the sake of clarity, FIG. 3 shows a side view of an unglued sheet 40 folded in accordance with the invention. A folded sheet has three portions 40*a*, 40*b* and 40*c*. The last folded sheet portion comprises the address field 42 and covers only in part the sheet portion 40*b* that it overlaps. If the sheet 40 is folded more than twice, only the last fold is reverse to the others.

The sheet 40 folded and perforated in the above manner is then introduced into the second path 20, on which the travel direction of the sheet is changed by about 90°. As the sheet 40 is forwarded on the path 20 by the conveyor line 22, the end edge 45 of the last folded sheet portion 40*c*—transverse to the lateral edges 41 of the sheet—and the open transverse edge 46 are opened slightly by opening means 23 and 24 and glue is sprayed on these slots by glue-guns 25 and 26. Glue can be sprayed e.g. in such a way that it forms a uniform line or points close to one another. The sheet 40 is then closed at these transverse glue joints 47 and 48 and perforations 49 are provided close to the glue joint 48 at the transverse edge in such a way that the glue joint 48 is closer to the transverse edge 46 of the finished sheet 40 than the perforation. Finally, the finished sheet 40, e.g. a letter, is introduced into the conveyor line 30, where it can be sorted out e.g. in accordance with postal areas.

The invention is described above by means of only one advantageous embodiment. However, it is possible for one skilled in the art to modify the details of the invention in several alternative ways within the scope of the attached claims.

I claim:

1. In a method for folding and gluing a sheet of paper that contains information and serves both as a letter and an envelope, which method comprises folding the sheet along a fold line transverse to parallel lateral edges of the sheet to define an end edge of the last folded sheet portion and a transverse edge;

closing the lateral edges, the end edge of the last folded sheet portion, and the transverse edge by glue joints to define folded and glued lateral edges;

perforating the folded and glued lateral edges and the transverse edge;

and changing a sheet travel direction by about 90° after closing of the lateral edges;

the improvement which comprises performing transverse gluing of the end edge of the last folded sheet portion and the transverse edge just before perforation by slightly opening sheet portions that are to be glued together, and by spraying glue therebetween.

2. A method according to claim 1, wherein the sheet is folded at least twice with respect to the lateral edges in such a way that the last fold is reverse to a preceding fold.

3. A method according to claim 1, wherein the last folded sheet portion covers only in part the sheet portion that it overlaps.

4. A method according to claim 1, wherein the opening is performed mechanically.

5. A method according to claim 1, wherein the opening is performed pneumatically.

6. A method according to claim 1, wherein glue is sprayed as a complete uniform line during the transverse gluing.

7. A method according to claim 1, wherein glue is sprayed as points close to one another during the transverse gluing.

* * * * *